United States Patent [19]

Wallace

[11] Patent Number: 4,565,413

[45] Date of Patent: Jan. 21, 1986

[54] PORTABLE DESK

[76] Inventor: Gary E. Wallace, Rte. 5, #25 Lazy S La., Chico, Calif. 95926

[21] Appl. No.: 577,586

[22] Filed: Feb. 6, 1984

[51] Int. Cl.[4] ..... A47B 53/00

[52] U.S. Cl. ..... 312/184; 312/282; 312/323

[58] Field of Search ..... 312/208, 183, 281, 184, 312/313, 186, 187, 323, 282; 108/5; 220/331, 20, 22.2, 22.3, 22.5

[56] References Cited

U.S. PATENT DOCUMENTS

| | | | |
|---|---|---|---|
| 343,779 | 6/1886 | Le Grand Terry | 211/46 |
| 843,719 | 2/1907 | Umberger | 312/313 |
| 1,827,027 | 10/1931 | Maeder | 312/193 |
| 2,006,603 | 7/1935 | Nordmark et al. | 312/323 |
| 2,338,477 | 1/1944 | Wolters et al. | 220/331 |
| 2,986,438 | 5/1961 | Smathers et al. | 108/25 X |
| 4,164,299 | 8/1979 | Fuhr | 220/20 |
| 4,290,658 | 9/1981 | De Rosa | 312/184 |
| 4,305,217 | 12/1981 | Green et al. | 312/183 |
| 4,312,548 | 1/1982 | Posso | 312/183 |
| 4,418,968 | 12/1983 | Johannes | 312/184 |

*Primary Examiner*—William E. Lyddane
*Assistant Examiner*—Joseph Falk
*Attorney, Agent, or Firm*—Mark C. Jacobs

[57] ABSTRACT

A portable easily transportable desk having a top planar working surface, a utility compartment and beverage stowage area, and compartmentalized file and paper storage, all easily accessible to the user. The working surface can either be tilted upwardly or slid to provide an adjustable work surface.

7 Claims, 7 Drawing Figures

PORTABLE DESK

BACKGROUND OF THE INVENTION

1. Field of the Invention

The invention relates to desks; and, more particularly, to a portable desk having various compartments therein, for use by road personnel in their vehicles.

2. Description of the Prior Art

Various types of desks have been known in the past. There have been stationary four (4) and six (6) footed styles of varying lengths. Portable desks were known primarily in the late 1800's before the advent of the typewriter. Gracious ladies used portable writing desks on the veranda for letters and paying bills. In the last twenty years people have used TV snack trays and clipboards as substitutes for a true portable desk.

A desk for use in a car by a road salesman is unknown. They, too, use clip boards to write on and a cardboard box to carry files. There is thus a need for a portable desk for use in a car or truck that will permit the carrying of files, in a manner similar to a file cabinet, and which desk has a writing surface and storage areas for literature, pens, samples, etc. Perhaps even a coffee mug or soda can.

SUMMARY OF THE INVENTION

It is an object of this invention to provide an improved portable desk.

It is a further object of this invention to provide a portable desk having suspended file storage, compartmentalized file and paper storage and a beverage area.

It is still further an object of this invention to carry out the foregoing objects in a desk which can be used in a car or the like and has a working surface that is laterally adjustable.

These are other objects are preferably accomplished by providing a portable easily transportable desk having a top planar working surface, a utility compartment and beverage storage areas, and compartmentalized file and paper storage, all easily accessible to the user. The working surface can either be tilted upwardly or slid outwardly to provide an adjustable work surface.

DESCRIPTION OF THE PREFERRED EMBODIMENT

Figure 1:
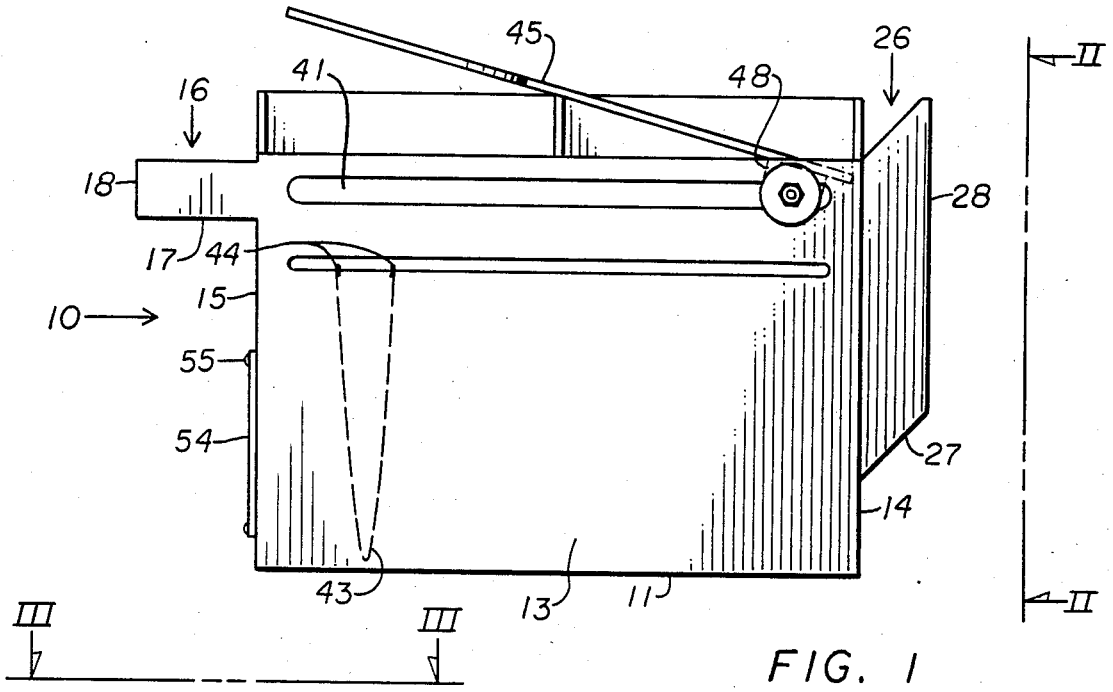
FIG. 1 is a front vertical view of a portable desk in accordance with the invention showing the upper horizontal working surface in raised or tilted position.
Figure 2:
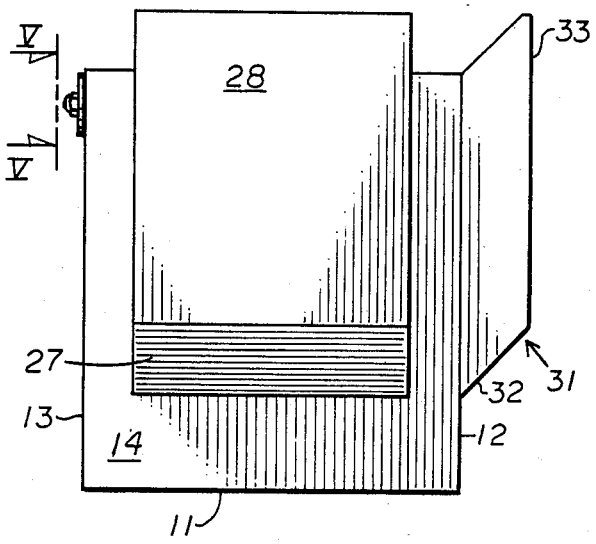
FIG. 2 is a view taken along lines II—II of FIG. 1.

Referring now to FIG. 1 of the drawing, a desk 10 is shown having a generally box-like configuration. Thus, desk 10 includes a bottom wall 11, an upstanding back wall 12, an upstanding front wall 13 and upstanding right and left side walls 14,15, respectively, forming an open top box or enclosure as seen in FIGS. 1 and 2. Desk 10 is shown as comprised of transparent plastic materials for convenience of illustration only, but, as will be discussed, may be made of any suitable planar materials.

Figure 3:
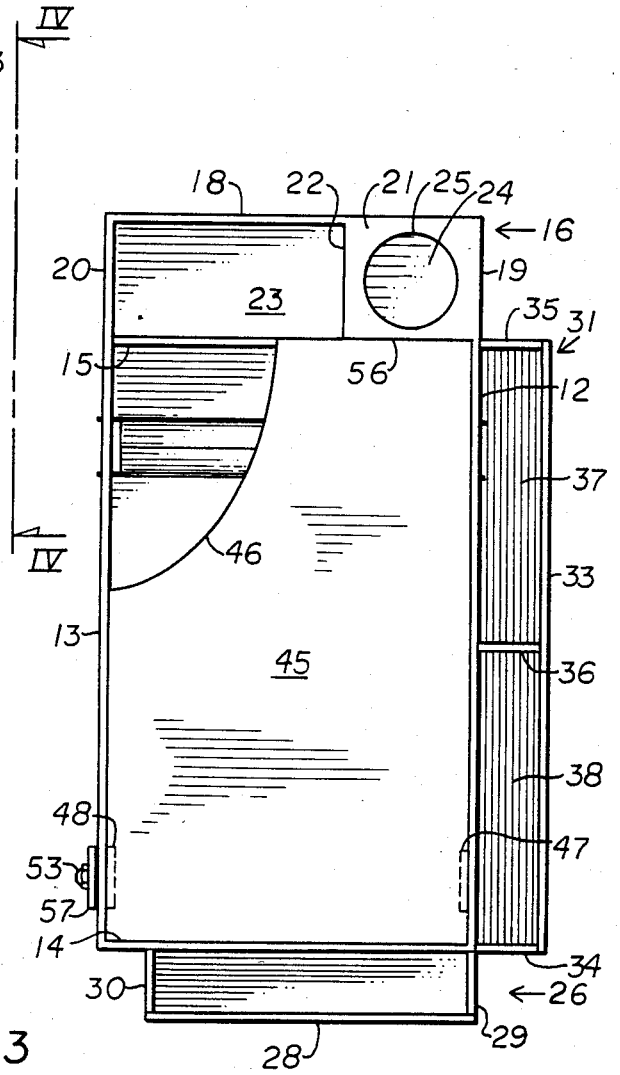
FIG. 3 is a view taken along lines III—III of FIG. 2.

As shown in FIG. 3, a shelf compartment 16 (FIG. 1) may be provided at the upper portion of left side wall 15. Compartment 16 includes a bottom wall 17 (FIG. 1), side wall 18 spaced from wall 15 and spaced end walls 19,20 (FIG. 3). Top wall 21 closes off the upper open end of compartment 16 and, with upstanding partition wall 22, divides compartment 16 into a utility storage section 23 (open to the atmosphere) and a beverage storage section 24 (provided by a hole or opening 25 in top wall 21 thus retaining a can or bottle therein).

A paper storage area 26 (FIG. 1 and FIG. 2) is provided on right side wall 14, open at the top, having a slanted bottom wall 27, back wall 28 spaced from wall 14, and spaced side walls 29,30 (FIG. 3) with back wall 28 extending above the top of walls 12 through 15 (FIG. 1) as shown and side walls 29,30 shaped accordingly thus providing easy access to area 26 for storage of papers therein. Utility storage 23 is for clips, pens, rubber bands, etc.

A second storage area 31, similar to area 26, is provided across the back wall 12 of desk 10. Thus, area 31 includes a slanted bottom wall 32 (FIG. 2), a back wall 33 spaced from wall 12 and extending above the upper surfaces of walls 12 through 15, and interconnected side walls 34,35 (FIG. 3). An upstanding partition wall 36 divides area 31 into two separate compartments 37,38 which can be used for storage of separately categorized files or documents.

Figure 4:
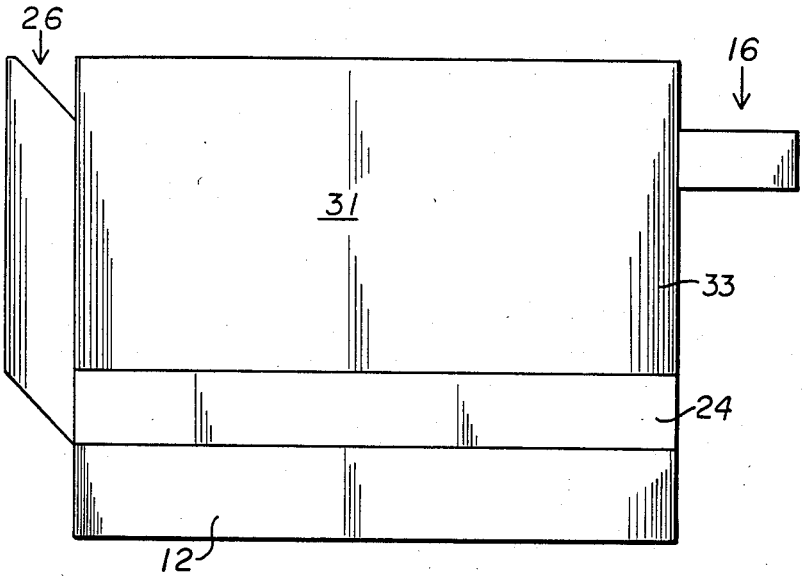
FIG. 4 is a view taken along lines IV—IV of FIG. 2.

As seen in FIG. 4, a pair of vertically spaced horizontally extending elongated slots 39 and 41 are provided in back wall 12. Similar slots 40,42 are provided in front wall 13 (FIG. 1). It is to be understood that slots 39 and 41 are aligned and lie in the same horizontal plane. Similarly, slots 40 and 42 are aligned and lie in the same horizontal plane. These slots are of any dimensions suitable to carry out their functions, as will be discussed. For example, slots 39,41 are wider than slots 40,42 for reasons to be discussed.

Slots 40,42 are disposed in walls 12,13 a suitable distance above bottom wall 11 so that a file folder or the like, such as folder 43 in FIG. 1, can be suspended from suitable conventional hangers 44 or the like which are supported by and ride in slots 40,42 as shown (the lower edges or bottom of folder 43 being spaced above bottom wall 11). Of course, one or more sets of aligned slots similar to slots 40,42 may be provided to accomodate folders of differing dimensions.

Figure 5:
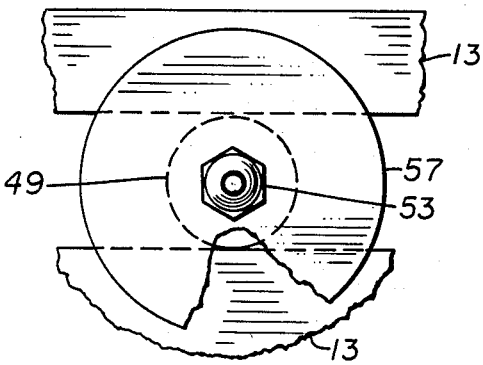
FIG. 5 is a detailed view of one feature of the invention.
Figure 7:
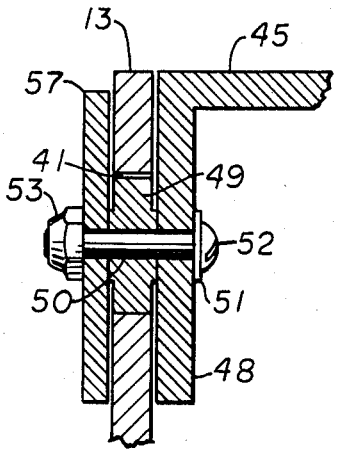
FIG. 7 is a cross-sectional view of a roller mounted in a trackway.

The upper open end of desk 10 is closed off by a planar horizontal surface 45 shown in raised position in FIG. 1 and best seen in FIG. 3. Surface 45 has a cut-out portion 46 at one end (FIG. 3) for easy lifting of surface 45 and is generally flush with the top of desk 10 (e.g., slightly above wall 21). Surface 45 is secured to desk 10 by a pair of flanges 47,48 (see particularly FIGS. 1 and 2) extending downwardly from opposite sides of the end of surface 45 opposite that having cut-out portion 46 therein. Each flange 47,48 (see FIG. 5) is on the inside of walls 12,13 and carries a roller 49 movable in slots 39,41 rotatably mounted by a screw 50 passing through each flange 47,48 and the center of roller 49 with spacer 51 between the head 52 of screw 50 and roller 49. Lock nut 53 (FIG. 4) on screw 50 secures roller 49 to its respective flange 47,48. See also FIG. 7. This system prevents undesired lateral movement of the desk top and permits easy back and forth travel.

Figure 6:
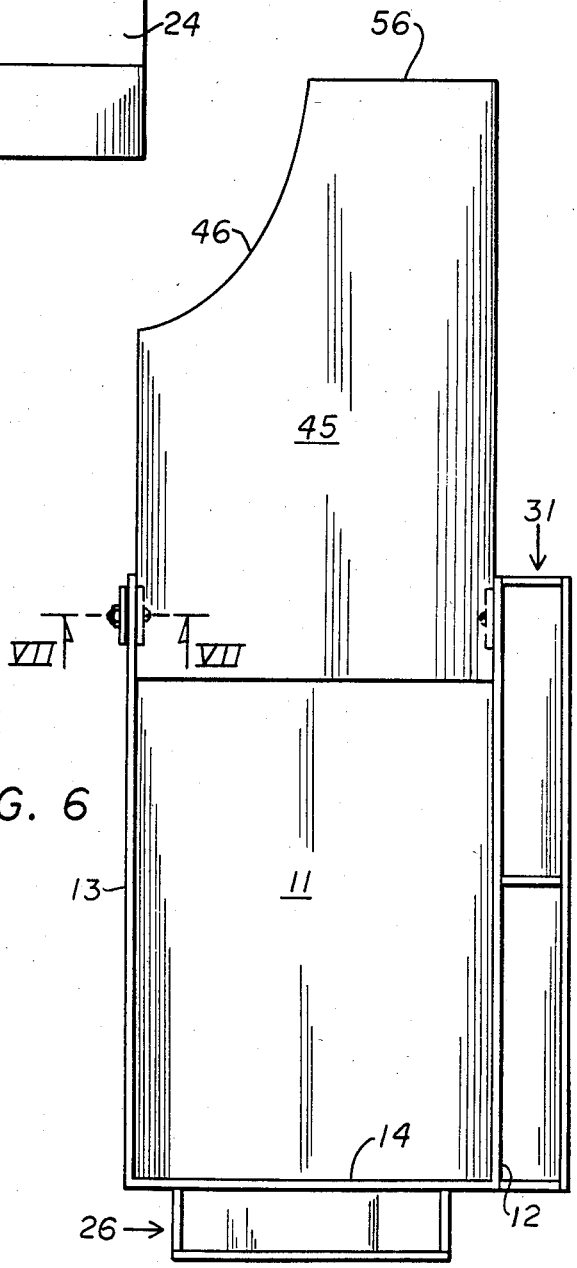
FIG. 6 is a view similar to FIG. 3 showing the desk top slid outwardly from the desk.

Thus, as shown in FIG. 1, since flanges 47,48 are on the inside of walls 12,13 and rollers 49 move in slots 39,41 in walls 12,13, the entire surface 45 can be pivoted upwardly (FIG. 1) for access to the interior of desk 10 or slid along slots 39,41 (see FIG. 6) so that it can slide out and away from wall 14. Thus, the desk 10 can be easily adjusted to accomodate all sizes of users if used in a cramped location, such as a car.

The desk 10 may be made of any suitable materials, transparent or opaque, such as wood, acrylic plastic, fibreboard covered with vinyl, etc.

Obviously, the size and shape of disk 10 may vary and the partitions and planar sections may be rounded at their edges. The various compartments formed in the desk 10 may also be used in various ways and, if desired, suitable locking means may be provided on work surface 45 and wall 15 so surface 45 can be locked. Such locking means may include a removable section conforming generally to the shape of area 46 so that the opening in desk 10 formed thereby is also closed and locked.

If desired, a conventional cork board 54 (FIGS. 1 and 4) may be removably secured to desk 10 as by means of a pin 55 or the like securing board 54 to one wall of desk 10, such as side wall 15. Pin 55 is preferably threaded & secured by a nut.

The hangers 44 are conventional items and also serve to space the suspended folders. Although the bottoms 27 and 32 need not be angled, such angling is preferred since it, in effect, offsets each paper or publication or file so that it is easy to read what papers are stored in these areas.

The desk 10 is quite portable and can easily sit in a car on the set thereof. If desired, cut-outs may be made in the upstanding walls for carrying purposes. Alternatively, easily detachable or permanently fixed handles may be provided. The bottom wall 11 may be provided with cushioning material on its undersurface so that the desk 10 does not scratch the car seat when resting thereon.

Suitable hooks may be provided in desk 10. For example, Velcro material may be used fixedly secured to the inside of the upstanding walls. Hooks having mating Velcro material may then be quickly and easily secured to the permanently fixed Velcro material.

It can be seen that there is disclosed a simple but convenient and easily transportable desk which can store papers, provide a work surface and suspend files.

A further feature lies in the use of the desk within the car or truck. It has already been pointed out that desk top 45 hinges upwardly to permit the salesman to gain access to the file storage area. It is further seen that when desk 10 is oriented with the wall 15 adjacent the right side of the body of a left hand drive vehicle's driver, desk top 45 can be rolled toward the driver on the roller assembly previously discussed. Cutout 46 permits the lead portion 56 per FIG. 4 of the surface (desk top) 45 to be placed directly in front of the driver to serve as a comfortable work surface, since the arcuate cutout 46 will rest almost snugly against the driver salesman's body. Thus he can easily write on a surface directly in front of him.

While a series of slots and rollers have been discussed to permit horizontal travel and the upraising of desk top (work surface) 45, other means within the skill of the art to achieve the same net effects are also contemplated. Movement of the desk forward on the right seat for the top to gain clearance of the driver's tummy may be employed.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A portable easily transportable desk suitable for use on the seat of an automobile, which desk comprises:

a bottom wall, a front wall and a back wall, normal to said bottom wall, each connected to the bottom wall, and upstanding therefrom in a spaced relationship, a pair of parallel side walls, interconnecting said front and rear walls, and said bottom wall, all of said walls together forming an enclosure that is open at the top;

a top surface planar member suitable as both a writing surface and as a closure for the open top, said top surface planar member being pivotable and slideable with respect to said enclosure, the pivoting means being at one end of the planar member and acting as a connecting means for connecting said planar member to said enclosure, said top planar member being pivotally connected at one end of same to said enclosure, wherein said connecting means includes a pair of horizontally extending slots in said front and back walls, respectively, said slots being aligned and lying in substantially the same horizontal plane, and roller means mounted on said top member engaging said horizontal slots, whereby said planar member may be pivoted from a flat position covering said enclosure, to a raised position with the non-connected end of said planar member away from the top opening of the enclosure, and said top planar member may be slid on said slots horizontally away from one of said enclosure's side walls toward a user of the desk, and wherein said top planar member includes a cut out portion adapted to accommodate the body of the user of said desk, when said top planar member is slid toward said user.

2. In the desk of claim 1 wherein said roller means includes a pair of downwardly extending flanges on opposite sides of said surface member and a roller fixedly secured to each flange of a diameter conforming to the width of said slot and movable therealong, thus preventing lateral movement of the top.

3. In the desk of claim 1 including a second slot in each front and back wall, each of said second slots being spaced from the first slots and also lying in substantially the same horizontal plane for receiving hangers therein for suspending file folders therefrom.

4. In the desk of claim 1 including a utility and a beverage compartment fixedly secured to one of the side walls of said enclosure at the top thereof.

5. In the desk of claim 4 wherein said utility and beverage compartment includes a first compartment open at the top for holding desk items therein and a second compartment closed at the top but apertured to receive a can or bottle therein.

6. In the desk of claim 1 including an open top paper storage area fixedly secured to one of the side walls of said enclosure having a slanted bottom wall slanting upwardly away from said side wall to which it is secured for retaining papers therein.

7. In the desk of claim 1 including an open top paper storage area fixedly secured to the back wall of said container having a slanted bottom wall slanting upwardly away from said back wall and a vertical partition dividing said open top paper storage area into two separate sections for storing papers therein.

* * * * *